US005912623A

United States Patent [19]

Pierson

[11] Patent Number: 5,912,623

[45] Date of Patent: Jun. 15, 1999

[54] HOUSE ARREST MONITORING SYSTEM WITH IMPROVED TAMPER DETECTION

[75] Inventor: Martin D. Pierson, Cave Creek, Ariz.

[73] Assignee: Alert Systems Corporation, Scottsdale, Ariz.

[21] Appl. No.: 08/980,224

[22] Filed: Nov. 28, 1997

[51] Int. Cl.[6] ..... G08B 23/00

[52] U.S. Cl. ..... 340/573.4; 340/572.1; 340/539; 340/571; 340/568.4; 455/100

[58] Field of Search ..... 340/573.4, 573.1, 340/572.1, 539, 825.54, 568.4, 508, 506, 504, 540, 571; 379/38; 455/100

[56] References Cited

U.S. PATENT DOCUMENTS

| | | | |
|---|---|---|---|
| 4,032,916 | 6/1977 | Galvin et al. | 340/508 |
| 4,253,091 | 2/1981 | Frydman | 340/506 |
| 4,369,436 | 1/1983 | Lautzenheiser | 340/506 |
| 4,885,571 | 12/1989 | Pauley | 340/573 |
| 4,980,671 | 12/1990 | McCurdy | 340/568 |
| 5,032,823 | 7/1991 | Bower et al. | 340/572.8 |
| 5,075,670 | 12/1991 | Bower | 340/573 |
| 5,115,223 | 5/1992 | Moody | 340/573.1 |
| 5,117,222 | 5/1992 | McCurdy | 340/573 |
| 5,146,207 | 9/1992 | Henry | 340/573 |
| 5,204,670 | 4/1993 | Stinton | 340/825.54 |
| 5,206,897 | 4/1993 | Goudreau et al. | 379/38 |
| 5,298,884 | 3/1994 | Gilmore | 340/573 |
| 5,430,434 | 7/1995 | Lederer et al. | 340/540 |
| 5,461,390 | 10/1995 | Hoshen | 342/419 |
| 5,512,879 | 4/1996 | Stokes | 340/573.4 |
| 5,525,969 | 6/1996 | LaDue | 340/573.4 |
| 5,543,780 | 8/1996 | McAuley | 340/573 |
| 5,570,079 | 10/1996 | Dockery | 340/541 |
| 5,612,675 | 3/1997 | Jennings et al. | 340/573.1 |
| 5,627,520 | 5/1997 | Grubbs et al. | 340/572.1 |
| 5,731,757 | 3/1998 | Layson, Jr. | 340/573.1 |
| 5,793,290 | 8/1998 | Eagleson et al. | 340/573.4 |

*Primary Examiner*—Benjamin C. Lee
*Attorney, Agent, or Firm*—Joseph H. Roediger

[57] ABSTRACT

A house arrest monitoring system wherein a transmitter module is attached to the subject by a strap containing a number of conductors. The module includes a microprocessor which applies a voltage to selected conductors and establishes a voltage pattern on the conductors. Any detected change in the pattern causes the generation of a tamper signal. The system is set for monitoring by an optical signal to prevent unauthorized resetting following a tamper condition.

21 Claims, 2 Drawing Sheets

11
12
15
CLOCK
16
POWER SUPPLY
LOGIC & POLLING CIRCUIT
17
XMTR
18
RESET
14

11
26
32
31
20
21
31
22
25

22
26
20
25

11
21
21

HOUSE ARREST MONITORING SYSTEM WITH IMPROVED TAMPER DETECTION

BACKGROUND OF THE INVENTION

This invention relates to a house arrest monitoring system having improved tamper detection.

The increasing use of house arrest sentences as a substitute for incarceration has generated a need for reliable monitoring systems. To accomplish the primary purpose of checking to see if the monitored subject is abiding by the terms laid down by the judicial system, the personal monitoring system must not only be reliable, but also not capable of being easily defeated. The typical system is comprised of a securing strap which affixes an electronics module to a limb of the subject. The strap includes a conductor which completes an electrical circuit. Attempts to remove the attachment from the subject generally require that the strap be severed or decoupled from the module.

The ingenuity of monitored subjects has resulted in the defeating of monitors which rely solely on the detection of a change in the impedance of conductors in the strap. For example, the immersion of a portion of the strap in an ionic liquid such as salt water followed by decoupling has been found to defeat many of the monitoring systems. The subject having successfully tampered with the monitor is then free to move about and replace the monitor at his convenience. To avoid the defeating of the system by an immersion technique, there have been proposed a number of systems utilizing electrical reactance measurements between a pair of conductors in the strap to determine a tamper condition. Also, attempts have been made to utilize the characteristics of the body of the subject such as skin temperature to establish a normal operating condition. Any change in the monitored quantity detected over a number of tests indicates a tamper. The electrical measurement of body characteristics call for complex circuitry and leads to unreliable performance.

Accordingly, the present invention is concerned with the provision of an electric module and a securing strap for a monitoring condition which utilizes a plurality of conductors in the strap and establishes a voltage pattern for the conductors in the strap. Any variation in the pattern from that established is readily determined in the module to provide an indication of the tamper condition. The present system establishes a pattern of open and closed circuit conditions for the conductors in the strap. The pattern is preferably varied over time to defeat attempts to avoid detection by the bridging of conductors in the strap. In addition, the monitoring system is responsive to an optical reset signal after tampering only after the reset circuit has been initialized. Initialization is provided by a contacting device which is operated by the monitoring agent or officer.

SUMMARY OF THE INVENTION

The present invention is directed to a house arrest monitoring system wherein an electronics module is affixed to the limb of the subject by means of a strap containing a plurality, preferably six, of embedded conductors. The strap includes electrical connectors at each of its ends which are received in mating electrical receptacles in the housing for the module.

The electronics module includes a transmitter for periodically providing the signal which informs the central monitoring station that the subject remains in the prescribed area. In addition, the module includes a microprocessor coupled to the connectors at the opposing ends of the strap.

At one connector, the microprocessor establishes a voltage pattern for the plurality of conductors with sensing of the pattern occurring at the other connector. Preferably, adjacent conductors in the strap do not have the same applied voltage with alternate conductors having a low or no voltage applied thereto. In addition, the microprocessor is programmed to vary the applied voltage pattern over time to further render the system difficult to tamper with undetected. The microprocessor applies the voltages to selected non-adjacent conductors at one end of the strap and detects the pattern existing in the conductors at the opposing end of the strap. In the event that agreement does not exist over a period of time, the transmitter is directed to indicate that a tamper condition exists. Normally, this condition is indicated by sending a tamper code signal to the receiver.

The present system utilizes a novel resetting procedure before a reset of the monitoring operation takes place. The module includes a reset circuit triggered by the application of an initializing signal from a hand-held unit. The initializing signal enables a photo responsive circuit to respond to an optical reset signal. The optical reset signal instructs the microprocessor to test the strap and, if a correct reading is obtained, initiate a reset code to the system receiver. The hand-held unit is programmed to require the application of the correct user code before delivering the initializing signal to the module. Thus, the resetting of the monitoring system cannot be accomplished without the proper party using the appropriate unit.

The utilization of a plurality of embedded conductors in the strap coupled with the ability to apply a time-varying pattern of high and low voltages to selected conductors therein renders the subject invention essentially immune from the well-known tamper activities of monitored subjects. The voltage pattern simulates a pattern of open and closed circuits in the strap encircling the limb of the subject which renders the immersion and bridging techniques ineffective to defeat the system. By varying the pattern on the conductors, successful tampering without altering the electronic circuits in the module does not take place. Attempts to tamper result in the transmitter being directed to indicate that a tamper condition exists. The tamper condition is indicated until reset occurs. The combination of an initializing signal and optical reset signal prevent the restart of the system enabling the central monitoring apparatus to recognize that a tampering of the system has taken place.

Further features and advantages of the invention will be more readily apparent from the following detailed description of a preferred embodiment of the invention when taken in conjunction with the accompanying drawing.

DESCRIPTION OF THE PREFERRED EMBODIMENT

Figure 1:
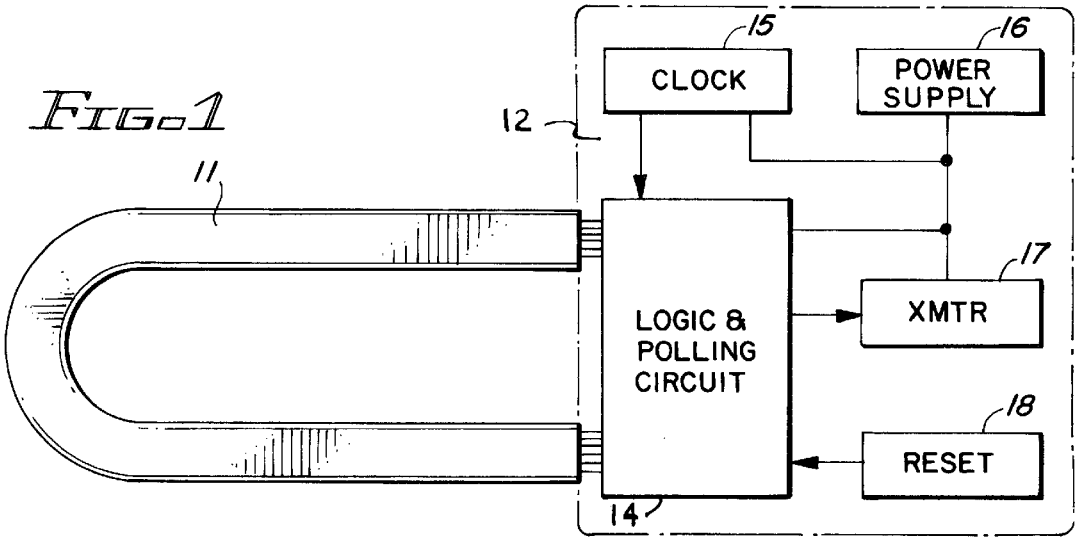
FIG. 1 is an electrical block schematic diagram of a preferred embodiment of the invention.
Figure 2:
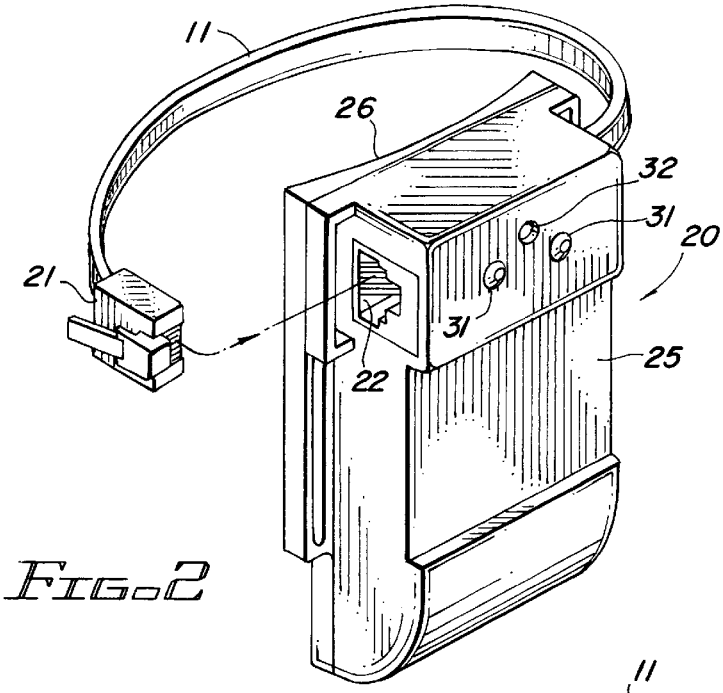
FIG. 2 is a view in perspective of the strap and electronics module of one embodiment of the invention.
Figure 3:
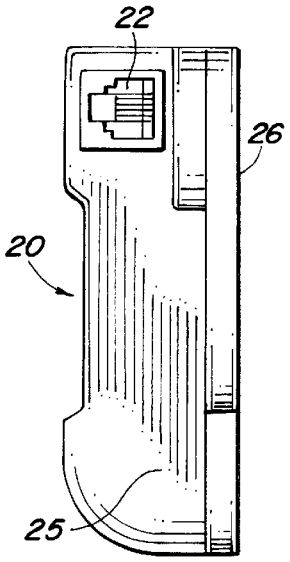
FIG. 3 is a side view of the electronics module shown in FIG. 2.

Referring now to FIG. 1, the block schematic diagram of the preferred embodiment of the invention includes a strap 11 for encircling a limb of the subject being monitored. The strap is connected at each of its ends to a mating receptacle in the housing of the electronics module 12. Module 12 is shown including a logic and polling microprocessor circuit 14 coupled to power supply 16 and clock circuit 15. The power supply is a battery contained within the housing of the electronic module 20 as seen in FIG. 2. Also, transmitter 17 is located within the housing 20 and, in normal operation, transmits a signal to a local receiver (not shown) whereupon it is detected to indicate that the subject with monitor attached is within the designated area. The local receiver is typically accessed via the telephone line by a central monitoring station. Since the goal of the system is to determine if the subject with monitor attached remains within the prescribed area during a predetermined period of time, it is customary for the transmitter to operate periodically rather than on a continuous basis to reduce the rate of energy consumption. In addition to determining when the monitor has left the prescribed area, it is necessary that the monitoring device indicate when it has been tampered with by removal from the monitored subject. The present system provides such an indication by utilizing a multiple conductor strap, applying a voltage pattern to the multiple conductors, varying the pattern according to the program in the microprocessor, monitoring the voltage pattern on the multiple conductors and detecting change in the pattern. A disconnecting of one of the connectors 21 from the corresponding receptacle 22 in the housing 20 of the electronics module disturbs the voltage pattern on the individual conductors in the securing strap by indicating that all conductors are open circuits. Similarly, the immersion of the entire device in an ionic liquid followed by a disconnect of the securing strap from the housing results in all conductors showing a completed or short circuit condition via the liquid. A similar result is obtained if the subject were to attempt to bridge the gap created by removal of the connector from the receptacle with a single conductor insert which would result in a short circuit of the individual conductors in the strap 11.

Figure 4:
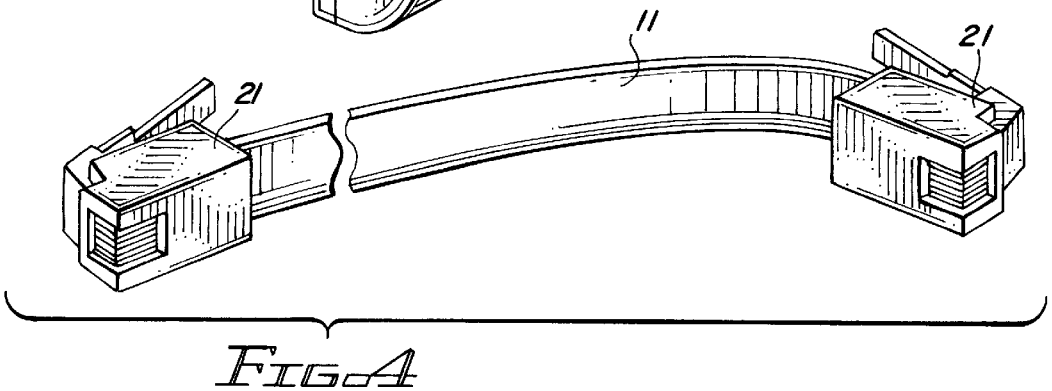
FIG. 4 is a view in perspective of the strap shown in FIG. 3.

The strap 11 is advantageously formed from a section of six wire conventional telephone line with the standard connectors affixed to each end. This type of securing strap is easy to affix to the subject, durable, low in cost and the connectors can be readily attached at the site after the strap length is determined. The strap is shown in FIG. 4 with a mating receptacle 22 for a standard six wire connector shown in the side view of housing 20. A support band, not show, is used to affix the electronics module 20 to the limb of the subject. A region 25 of reduced thickness is formed in the housing 20 to accommodate the support band which normally encircles leg of the subject. The opposing surface 26 of the housing 20 is curved to fit more comfortably on the subject.

Figure 6:
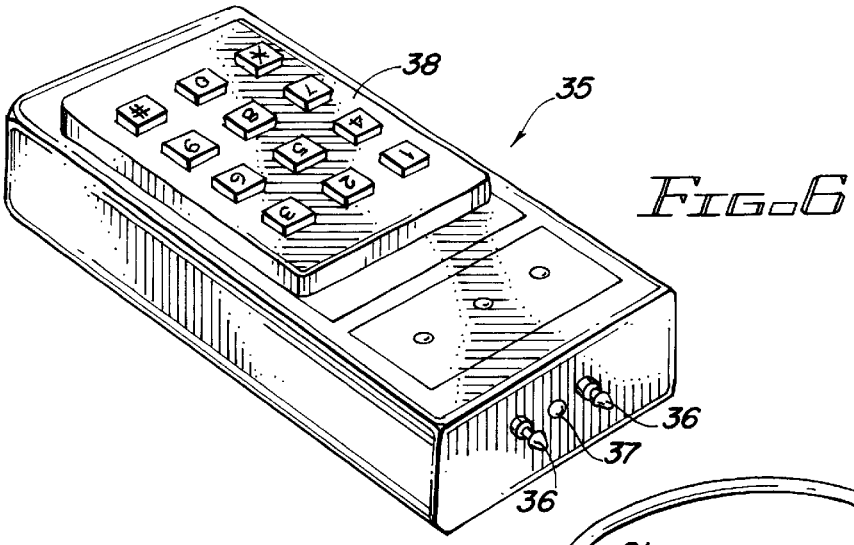
FIGS. 6–7 are views in perspective of a hand-held unit used for resetting operation of the embodiment shown in FIG. 2.
Figure 7:
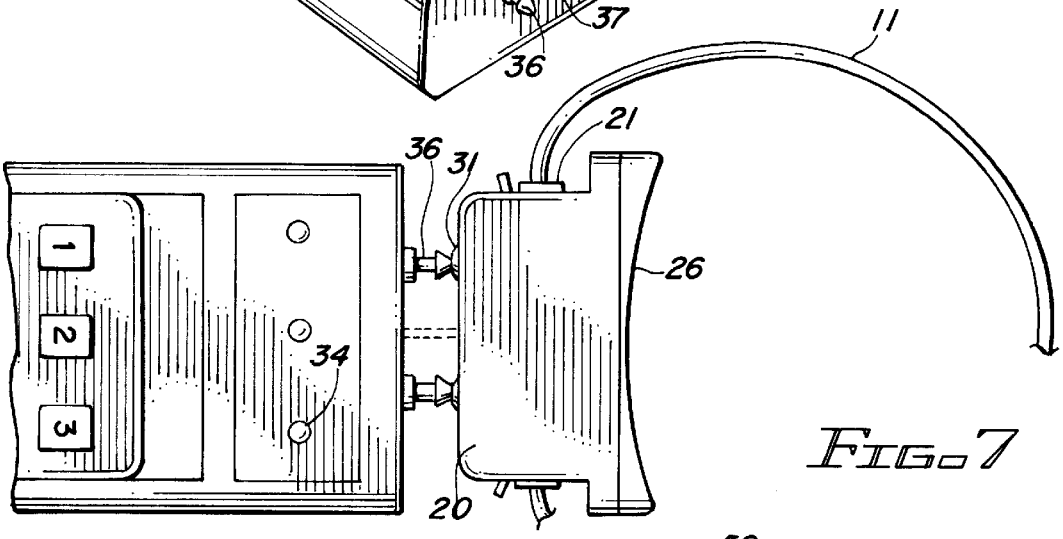

The housing 20 is also provided with external electrical terminals 31 which contact the prongs 36 on the hand-held reset device 35 of FIG. 6. Also, an aperture 32 is provided in housing 20 to receive an optical reset signal. The aperture 32 is preferably aligned with respect to prongs 36 so that the hand-held reset device 35 can be utilized to initialize the system by means of an electrical signal applied via prongs 36 followed by application of the optical reset signal without requiring a change in position. As will be noted in FIG. 1, a reset circuit 18 is incorporated in the electronics module to enable the system to resume operation after a disabling event, either intentional or through an unauthorized tamper. The alignment of the reset device 35 with the housing for the electronics module is shown in FIG. 7 wherein prongs 36 make contact with terminals 31 and the path of the optical reset signal is shown by the dashed line extending between the reset device and the housing.

The hand-held reset device is provided with a keypad 38 to control the use of the device with the preferred embodiment. The operator seeking to initiate operation of the electronics module and transmitter therein is required to enter a multi-digit code to activate the device when it is in place on the subject and to apply an initializing voltage, e.g. 24 volts, between the prongs 36. To aid in the operation of the reset device, a series of colored lights 34 are used to guide the operator. In the embodiment shown, the entry of the correct code via the keypad causes a yellow light to turn on. Then, upon firm contact of the prongs 36 with terminals 31 a red light flashes to show contact between devices and that the initializing signal has been sent to the electronic module. The initializing signal tells the microprocessor to look for the optical reset signal and to test the band by applying the same signal to all conductors in the securing band to verify that the connectors are properly secured in the mating receptacles. The third light is green and is used to conduct a test of the strap before the system is placed in operation. The optical signal transmitted to the module is typically an uncoded series of pulses. The use of a separate reset circuit, for example an optical isolator circuit such as an NEC 2701 circuit, is used to prevent static conditions from jolting the subject or the subjects own activity from generating a static charge which will harm the circuits. Thus, the initialization signal is isolated from the electronics module. The reset signal is a series of signal pulses which render a phototransistor in the electronic module conductive and activate the microprocessor and transmitter.

In operation, the band with its six conductors has three non-adjacent conductors at a present voltage level while the other three non-adjacent conductors have no applied voltage. The voltage pattern is applied at one end of the securing strap and the voltage pattern at the other end is compared. In the event that the voltage patterns differ, the microprocessor generates a signal for the transmitter to indicate a tamper condition. The polling of the condition of the securing band occurs in this embodiment every 0.1 sec. While the securing band has six conductors with three simulating an open circuit and three simulating a closed circuit, it is to be noted that the simulation is provided by the microprocessor applying voltages to only selected conductors and that physically all six conductors are in fact connected between the receptacles and are in use.

The microprocessor is preferably used in a manner which varies the three conductors in each set to increase the difficulty in successfully tampering with the system. By alternating the voltage applied to adjacent wires, the opportunity to defeat the system by the use of jumpers is essentially eliminated. The individual wires are small in diameter and closely spaced within the external sheath. While three conductors are preferred due to availability of low cost conductive securing straps, the number can be changed if conditions dictate. In operation, three conductors for each condition have been found to provide the necessary redundancy to eliminate false triggering. In the event that the voltage pattern sensed does not coincide with the pattern established, the microprocessor is programmed to cease testing until reset is initiated by an authorized agent.

Figure 5:
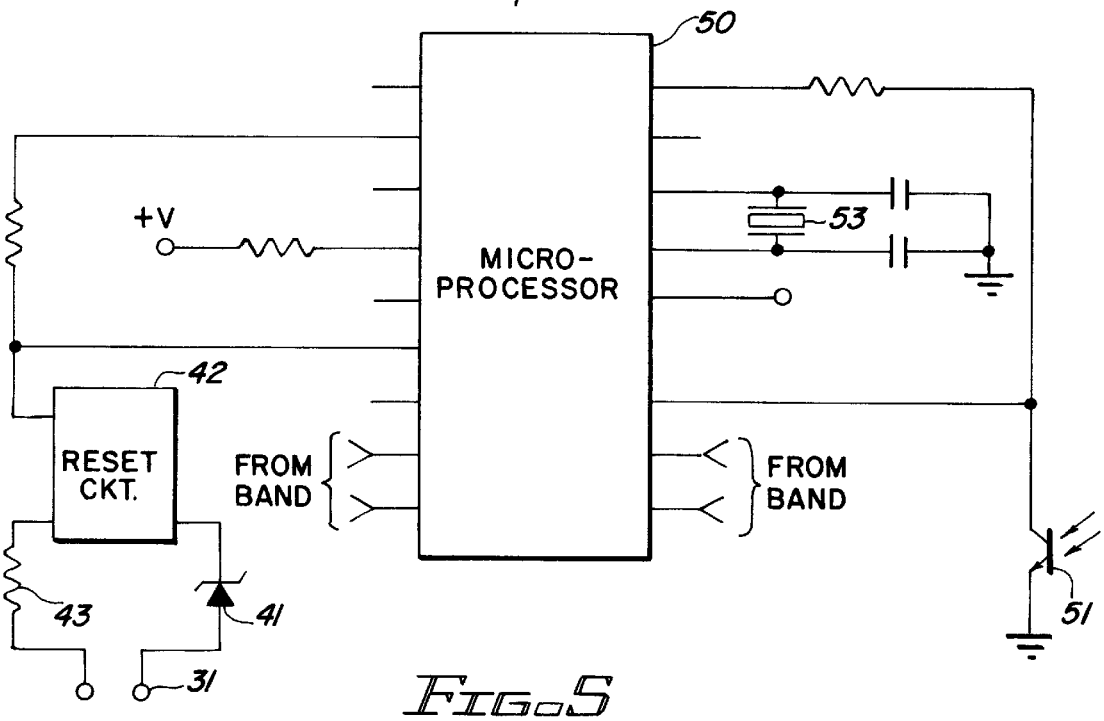
FIG. 5 is an electrical schematic diagram of the embodiment of FIG. 1.

The electronic circuit is shown in FIG. 5 in block schematic form wherein the reset circuit 42 which is comprised of an optoisolator circuit is coupled via zener diode 41 and current limiting resistor 43 to the external terminals 31 on housing 20. The zener diode has a present threshold voltage and the hand-held reset device is designed to provide an appropriate voltage between prongs 36. When the reset circuit 42 is initialized, the signal provided to the microprocessor 50 is low and conditions the microprocessor to receive a signal from photo transistor 51. The optical pulse signal enters the housing 20 at aperture 32 and renders transistor 51 conducting.

In this embodiment, the microprocessor is a Model P1C 16 LF84 made by Micro Chip Technologies and is provided with a crystal 53 resonator for the internal clock signal. The microprocessor is coupled to groups of three conductors. It applies the voltage pattern to one group and polls the opposing end to determine if there is a variation in the pattern. In the event that a variation is detected, a signal is provided to the transmitter to tell it to indicate a tamper condition. At this time, all polling of the conductors is terminated.

The subject invention relies on the generation of open and closed circuit conditions on multiple conductors in a strap. The use of multiple conductors enhances reliability and reduces the ability of the subject to successfully tamper with the system. By alternating the application of open and closed circuit conditions and changing the polling accordingly, defeating the system by tampering is essentially impossible. While the foregoing description has referred to a particular embodiment of the invention, it is to be noted that modifications may be made therein without departing from the scope of the invention as claimed.

I claim:

1. An electronic monitor for attachment to a subject being monitored wherein a tampering of the monitor is detected and a tamper condition is indicated, said monitor comprising:

a) a strap terminating in first and second connectors, said strap containing a plurality of conductors each having a first end and a second end, said conductors extending between said first and second connectors;

b) a module having first and second engaging means for receiving the first and second connectors respectively, said strap and module being attached to the subject;

c) a transmitter contained within said module for generating a monitor signal, said transmitter indicating a tamper condition when the strap and module are disconnected;

d) means for applying a voltage to the first end of selected conductors in the strap to establish a voltage pattern at the second ends of said plurality of conductors;

e) means for monitoring the voltage pattern at the second ends to determine a change in voltage pattern causing the transmitter upon detection of a change to indicate a tamper condition.

2. The monitor in accordance with claim 1 wherein said means for applying a voltage to the selected conductors operates intermittently.

3. The monitor in accordance with claim 2 wherein said means for applying a voltage to the selected conductors is time variable whereby the voltage is applied to different conductors of said plurality of conductors.

4. The monitor in accordance with claim 3 wherein said means for applying a voltage is programmable to provide a varying voltage pattern.

5. The monitor in accordance with claim 1 further comprising an optical reset circuit contained within the module, the application of an optical reset signal reinitiating operation of the monitor.

6. The monitor in accordance with claim 5 further comprising an enabling circuit contained within the module for authorizing the optical reset circuit to receive a reset signal.

7. The monitor in accordance with claim 6 further comprising a clock signal generator contained within the module for establishing the rate for monitoring the voltage pattern.

8. The monitor in accordance with claim 1 wherein said plurality of conductors includes at least four adjacently spaced conductors.

9. The monitor in accordance with claim 8 wherein said means for applying a voltage to the first ends of selected conductors applies voltage to two non-adjacent conductors in the strap.

10. The monitor in accordance with claim 9 wherein said means for applying a voltage to said first ends includes a microprocessor for establishing a varying voltage pattern at the second ends of said plurality of conductors.

11. The monitor in accordance with claim 10 further comprising an optical reset sensor in the module, the application of an optical reset signal to said sensor initiating operation of said transmitter.

12. The monitor in accordance with claim 11 further comprising an enabling circuit in the module for authorizing the optical reset circuit to receive a reset signal.

13. A method for detecting tampering of an electronic monitoring system attached to a subject being monitored which comprises the following steps:

a) providing a securing strap having opposing ends for electrical connection to an electronics module containing a transmitter, the strap containing a plurality of conductors therein:

b) securing the electronics module to the subject by attaching the module to the securing strap;

c) applying a voltage at an end of the strap to selected conductors in said plurality of conductors to establish a voltage pattern at the opposing end of the strap;

d) monitoring the voltage pattern at the opposing end and detecting a change in said pattern, the detection of a change indicating tampering with the monitoring system.

14. The method of claim 13 further comprising actuating the transmitter to generate a tamper signal upon detection of a change in said pattern.

15. The method of claim 14 wherein the voltage is applied to nonadjacent conductors in the securing strap.

16. The method of claim 15 wherein the voltage is intermittently applied to nonadjacent conductors.

17. The method of claim 16 wherein the voltage is applied to different conductors over a period of time thereby changing the voltage pattern accordingly.

18. The method of claim 17 further comprising the step of resetting the transmitter following the generation of the tamper signal.

19. A tamper condition detection circuit for detecting an unauthorized removal of a transmitter module from a monitored subject, said circuit comprising:

a) an encircling strap terminating in first and second electrical connectors;

b) a plurality of individual conductors embedded in said strap and extending between said first and second electrical connectors, and c) a transmitter module for receiving the first and second electrical connectors which includes:

i. first means for establishing a voltage pattern at the first electrical connector for the individual conductors;

ii. second means for sensing the voltage pattern on the plurality of conductors at the second electrical connector, and iii. third means for detecting a variation between the voltage patterns present at the first and second connectors, said variation indicating the presence of a tamper condition.

20. The tamper condition detection circuit in accordance with claim 19 wherein said first, second and third means are included in a microprocessor contained in the transmitter module.

21. The tamper condition detection circuit in accordance with claim 20 wherein said microprocessor establishes a voltage pattern at the first electrical connector by the application of a voltage to alternate conductors in the encircling strap.

* * * * *